US009260164B2

(12) United States Patent
Dupont

(10) Patent No.: US 9,260,164 B2
(45) Date of Patent: Feb. 16, 2016

(54) METHOD FOR TRANSFERRING FLUIDS BETWEEN A FIRST SHIP AND A SECOND SHIP, AND TRANSFER SYSTEM FOR IMPLEMENTING SAID METHOD

(75) Inventor: Bernard Dupont, Eaubonne (FR)

(73) Assignee: SOCIETE EUROPEENNE D'INGENIERIE MACANIQUE—EURODIM, Rueil Malmaison (FR)

( * ) Notice: Subject to any disclaimer, the term of this patent is extended or adjusted under 35 U.S.C. 154(b) by 1002 days.

(21) Appl. No.: 13/319,553

(22) PCT Filed: May 12, 2010

(86) PCT No.: PCT/FR2010/050932

§ 371 (c)(1),
(2), (4) Date: Dec. 28, 2011

(87) PCT Pub. No.: WO2010/130960

PCT Pub. Date: Nov. 18, 2010

(65) Prior Publication Data

US 2013/0025726 A1 Jan. 31, 2013

(30) Foreign Application Priority Data

May 13, 2009 (FR) ..... 09 53175

(51) Int. Cl.
*B63B 27/24* (2006.01)
*B63B 27/34* (2006.01)

(52) U.S. Cl.
CPC ..... *B63B 27/24* (2013.01); *B63B 27/34* (2013.01); *Y10T 137/6906* (2015.04)

(58) Field of Classification Search
USPC ..... 137/899.2, 343, 615, 899; 414/137.1, 414/137.9; 141/382, 387; 114/144 B
See application file for complete search history.

(56) References Cited

U.S. PATENT DOCUMENTS 3,211,121 A * 10/1965 Dozier ..... 114/144 B
3,982,402 A * 9/1976 Lang et al. ..... 405/168.3
4,190,090 A * 2/1980 Tuson ..... 141/387
4,261,398 A * 4/1981 Haley ..... 141/387

(Continued)

FOREIGN PATENT DOCUMENTS

EP 1 705 112 A1 9/2006
FR 1 569 861 6/1969

(Continued)

OTHER PUBLICATIONS

European Patent Office; International Search Report in International Patent Application No. PCT/FR2010/050932, (Jan. 6, 2011).

*Primary Examiner* — Kevin Murphy
*Assistant Examiner* — Jonathan Waddy
(74) *Attorney, Agent, or Firm* — Leydig, Voit & Mayer, Ltd.

(57) ABSTRACT

A method for transferring fluids between a first ship, called a barge, and a second ship, called a shuttle, in which the shuttle is positioned at a pre-determined distance from the barge, and a flexible fluid transfer conduit is guided from the barge to the shuttle. The shuttle is placed in a position laterally offset from the barge and essentially parallel to the longitudinal axis of the barge, and a fluid transfer system enables the shuttle to move in the lateral and longitudinal directions in relation to the barge, during a transfer. The invention is useful for the transfer of liquefied natural gas.

13 Claims, 9 Drawing Sheets

(56) References Cited

U.S. PATENT DOCUMENTS

| | | | | |
|---|---|---|---|---|
| 4,376,452 | A * | 3/1983 | Tax et al. | 137/615 |
| 5,634,421 | A * | 6/1997 | Velarde | 114/230.15 |
| 6,637,479 | B1 * | 10/2003 | Eide et al. | 141/387 |
| 6,817,914 | B2 * | 11/2004 | Breivik | 441/4 |
| 6,976,443 | B2 * | 12/2005 | Oma et al. | 114/144 B |
| 6,994,506 | B2 * | 2/2006 | de Baan | 414/139.4 |
| 7,147,021 | B2 * | 12/2006 | Dupont et al. | 141/382 |
| 7,299,835 | B2 * | 11/2007 | Dupont et al. | 141/382 |
| 2004/0011424 | A1 * | 1/2004 | Dupont et al. | 141/279 |
| 2007/0289517 | A1 * | 12/2007 | Poldervaart et al. | 114/230.15 |

FOREIGN PATENT DOCUMENTS

| | | | |
|---|---|---|---|
| WO | WO 00/78603 | A1 | 12/2000 |
| WO | WO 01/34460 | A1 | 5/2001 |
| WO | WO 03/078244 | A1 | 9/2003 |
| WO | WO 2008007033 | A1 * | 1/2008 |

* cited by examiner

METHOD FOR TRANSFERRING FLUIDS BETWEEN A FIRST SHIP AND A SECOND SHIP, AND TRANSFER SYSTEM FOR IMPLEMENTING SAID METHOD

FIELD OF THE INVENTION

The invention relates to a method for transferring fluids between a first ship, called a barge, and a second ship, called a shuttle, according to which the shuttle is positioned at a predetermined distance from the barge and guides at least one flexible fluid transfer conduit from it to the shuttle. The invention also relates to a transfer system for implementing that method.

According to methods of this type, which are known, the shuttle is positioned so as to be arranged substantially in the axis of the barge approximately 70 to 80 meters away from it before connecting the flexible conduits to the connection device provided on the shuttle. The latter is moored to the barge by a hawser during the transfer or is positioned dynamically. However, the tandem positioning has major drawbacks. In fact, given that the barge and the shutter are positioned according to the wind, currents and swell, there is a great risk of the shuttle being located in the zone of the direction of the flame generated by the flare, which is part of the standard equipment of the barge, on the one hand, and of the shuttle, by moving forward accidentally, frontally colliding with the rear portion of the barge. These risks already make the transfer of crude oil from the barge to the shuttle problematic, but also make it practically impossible to transfer liquefied natural gas (LNG) from the barge to the shuttle.

SUMMARY OF THE INVENTION

The invention aims to propose a solution to the problems stated above.

To achieve that aim, the method according to the invention is characterized in that the shuttle is placed in a position wherein the shuttle is laterally offset from the barge while being essentially parallel to the longitudinal axis of the barge, and a fluid transfer system is provided, which enables the shuttle to be moved in the lateral and longitudinal directions in relation to the barge, during a transfer.

According to one feature of the invention, cryogenic hoses are used as flexible transfer conduits to transfer liquefied natural gas.

The system according to the invention for implementing the method is characterized in that the barge supports a device for storing at least one flexible conduit, if applicable a cryogenic hose, with a length comprised between 60 and 120 meters, the conduit outlet mechanism of which rotates around a vertical axis and in that the device receiving the connecting tip of the conduit, provided on the shuttle, also rotates around a vertical axis.

According to one feature of the system according to the invention, the storage device is in the form of a wheel with a diameter comprised between 20 and 50 meters, around which the conduit is wound and from which the latter can be unwound during a fluid transfer, said wheel rotating around a horizontal axis and being able to pivot around a vertical axis.

According to another feature of the invention, the flexible conduit is wound in a peripheral slot of the wheel in a coil.

According to still another feature of the invention, the wheel includes a plurality of juxtaposed storage slots, if applicable to store several flexible conduits.

BRIEF DESCRIPTION OF DRAWING FIGURES

The invention will be better understood, and other aims, features, details and advantages thereof will appear more clearly in the following explanatory description done in reference to the appended diagrammatic drawings provided solely as examples and illustrating one embodiment of the invention and in which.

DETAILED DESCRIPTION

The invention will be described below, as a non-exclusive example, in its application to a transfer of liquefied natural gas (LNG) from a first ship, a LNG production barge 1, to a second ship, a shuttle 2.

Figure 1:
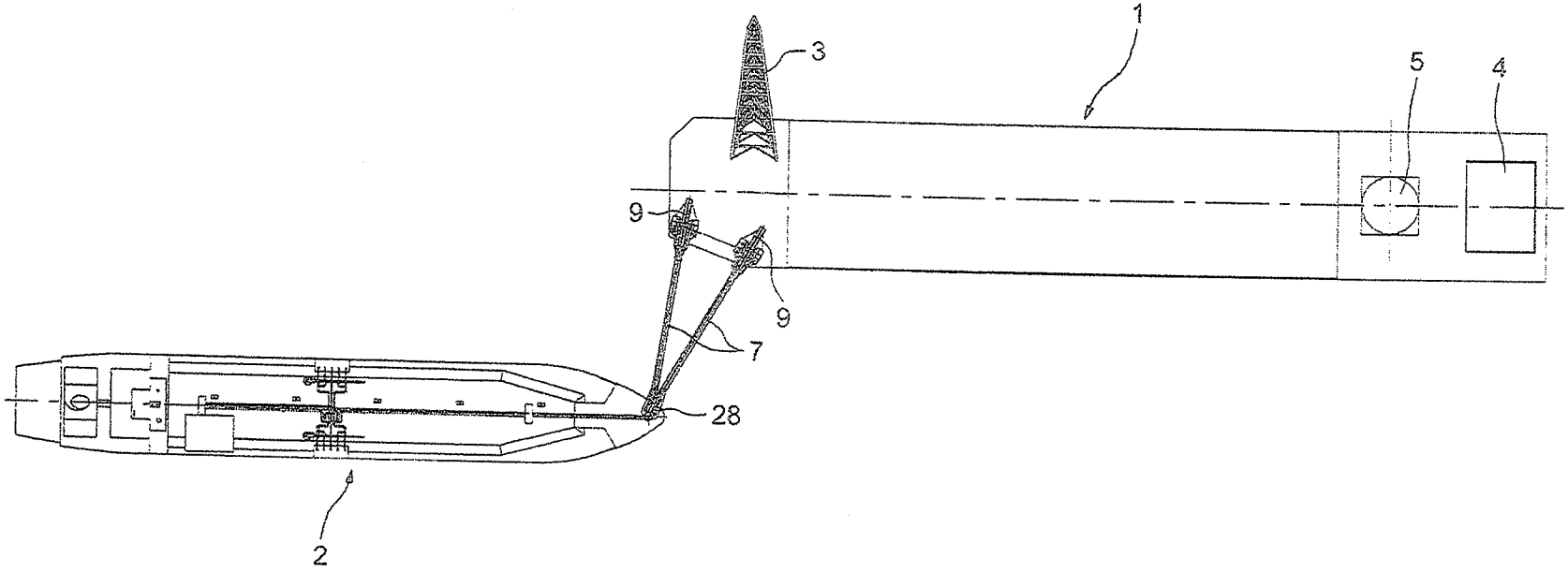
FIGS. 1 and 2 are two top views showing a barge and a shuttle in two fluid transfer positions, according to the invention.
Figure 2:
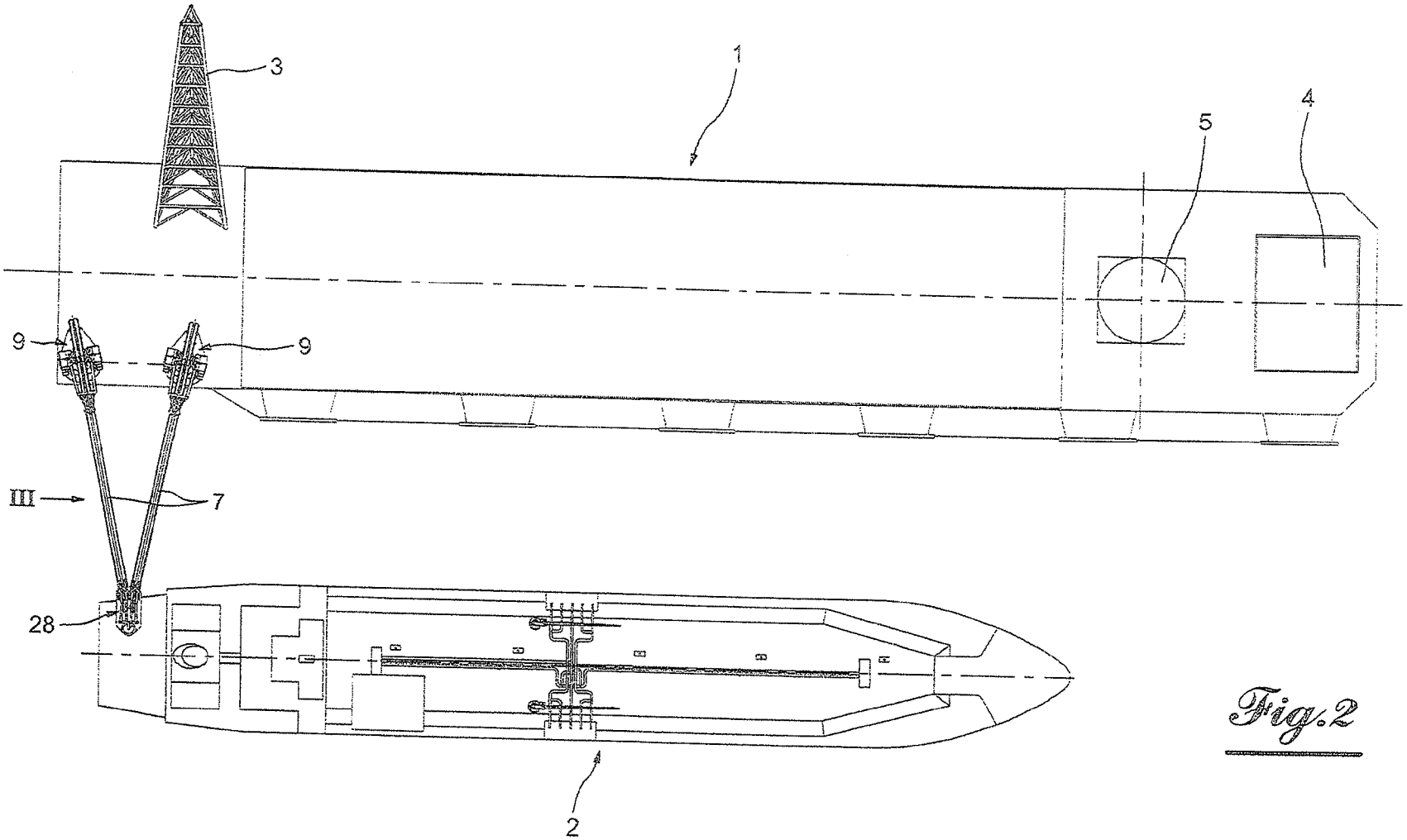
Figure 3:
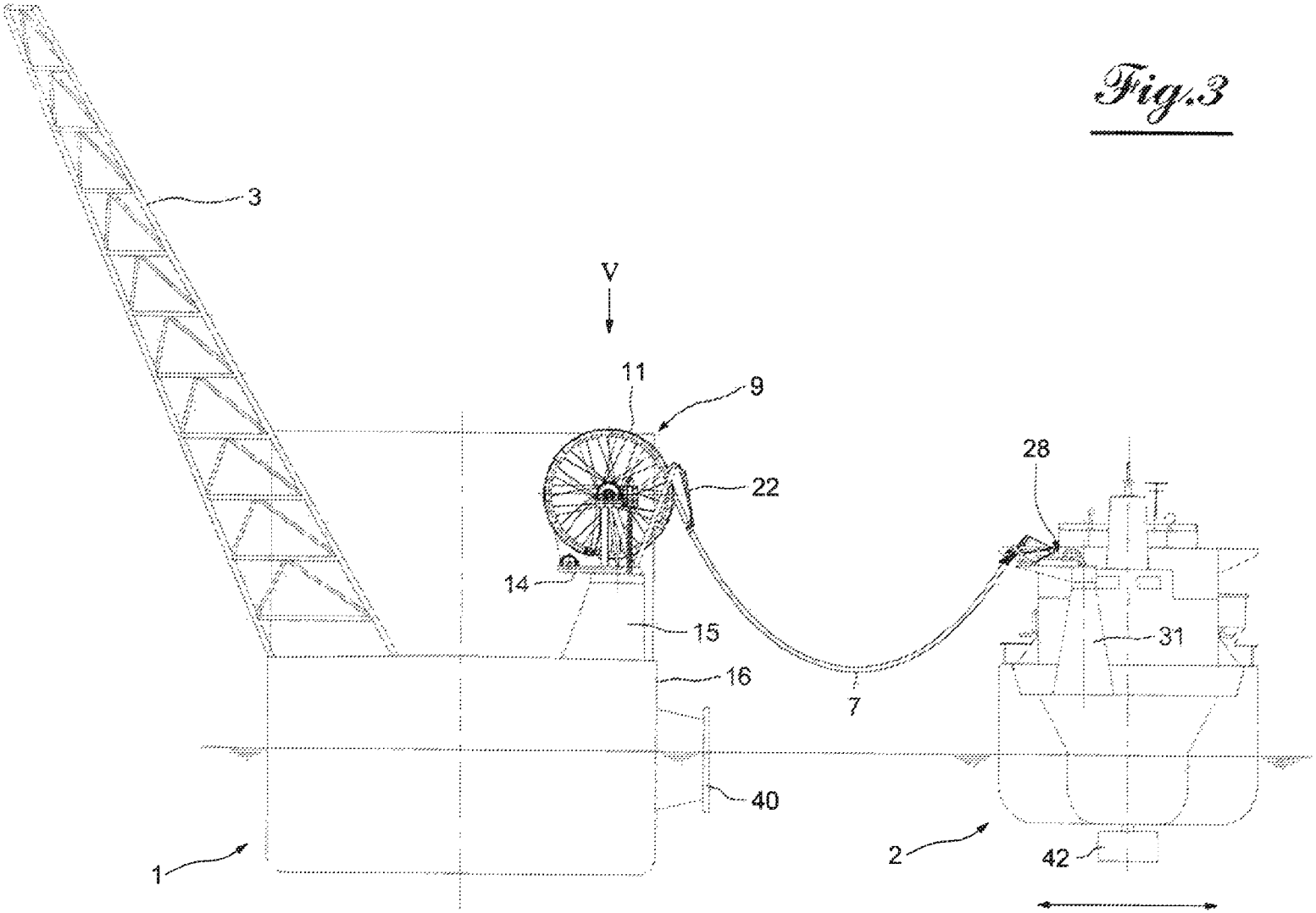
FIG. 3 is a view in the direction of the longitudinal axes of the two vessels, in the direction of arrow III of FIG. 2.
Figure 4:
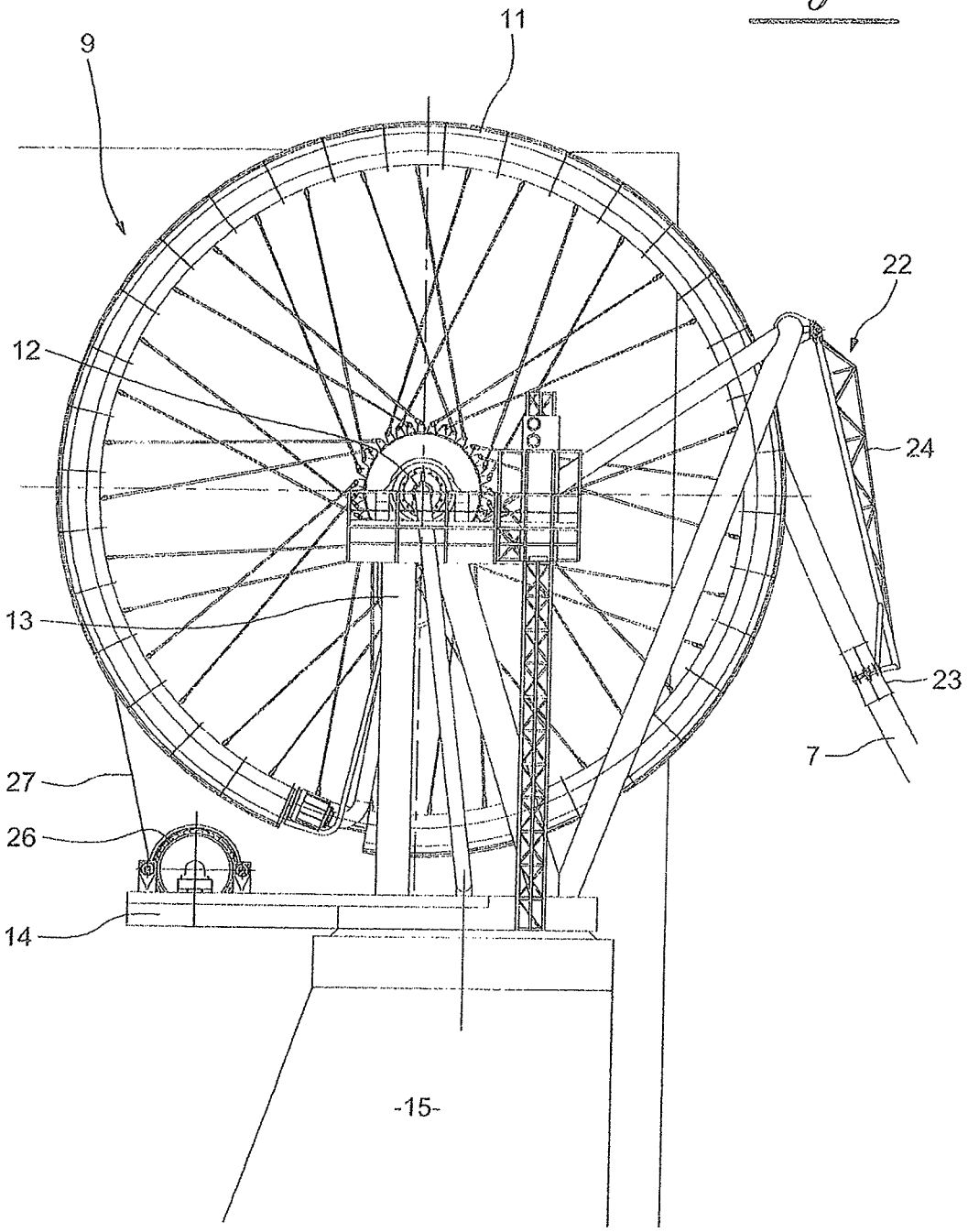
FIG. 4 is a larger-scale view of the cryogenic hose storage wheel according to the invention, mounted on the barge, according to FIG. 3.
Figure 5:
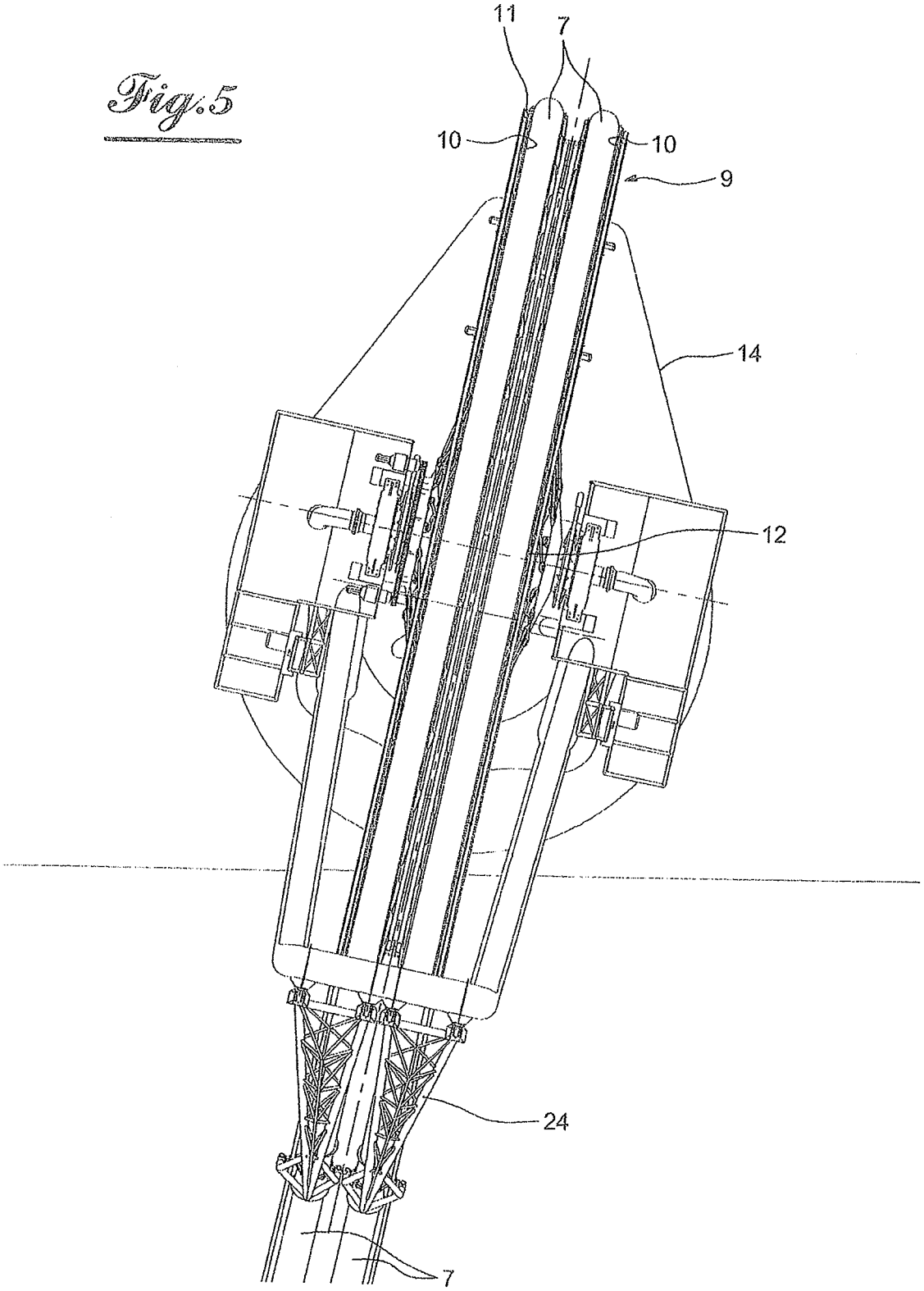
FIG. 5 is a top view of the storage wheel in the direction of arrow V of FIG. 3.

As shown in FIGS. 1 to 3, to perform such a LNG transfer, the shuttle 2 is dynamically positioned in a position wherein it is laterally offset from the barge and oriented substantially parallel to the longitudinal axis thereof, on the side opposite that of the flare 3 that is situated at one end of the barge and is part of the standard equipment of the barge, like the living quarters 4 and a mooring cable drum 5, provided at the other end thereof. The typical gap between the barge and the shuttle is approximately 70 to 80 meters. The transfer is done using cryogenic hoses 7 that are stored on the barge and have a great length so that a LNG transfer can occur under good conditions, even in the event of significant movement of the shuttle 2 relative to the barge 1.

The shuttle 2 is kept in position relative to the barge 1 by a dynamic positioning system provided on the shuttle 2. To that end, the latter is equipped with lateral thrusters 42 automatically controlled by the positioning system, for example bow thrusters. The dynamic positioning system automatically steers the shuttle during surges, sway and yaw by acting on the different propellers, such as the main and side propellers, so as to keep the shuttle in a predetermined position and/or on a predetermined course relative to a fixed or mobile reference, in the present case the barge 1. The position of the reference as well as the position of the shuttle is known by combining information from positioning systems (by satellite, GPS, inertial units, radars and similar).

According to the invention, the dynamic positioning system is used to maintain the shuttle, relative to the barge, in a position laterally offset from the barge and oriented substantially parallel thereto without the shuttle being connected to the barge by mechanical means such as a hawser. Thus, according to the invention, a fluid transfer between the shuttle and the barge, owing to the possibilities for dynamic positioning of the shuttle, then only requires that the longitudinal axis of the shuttle be pointed toward the stern of the barge.

To implement a LNG transfer from the barge 1 to the shuttle 2, the barge includes, on the end portion on which the flare 3 is installed, but close to the edge opposite the shuttle 2, by way of storage device for the transfer hoses, two large wheels 9 with a large storage capacity, having a diameter for example comprised between 20 and 50 meters, which each house, in two peripheral slots 10 of the rim 11, two cryogenic hoses 7.

Each wheel is rotatably mounted around a horizontal axis 12 supported at the top of a structure in the shape of a tower 13 arranged on an element in plate form 14, which is rotatably mounted around a vertical axis on a base 15 situated close to the edge 16 of the ship. Thus the axis of rotation 12 of the wheel can pivot around a vertical axis.

In the illustrated example, each wheel includes two peripheral grooves for housing a hose 7 whereof one end is fixed to the rim and connected to the piping of the barge while the other end is free and supports a tip 17 for connecting to the receiving device provided on the shuttle. As shown in particular in FIG. 6, the tip 17 supports the mounting clip 18. The two tips 17 of the two hoses 7 are mounted on a shared support that bears a centering pin 19 oriented parallel to the axes of the connectors and positioned above them, as well as a fall braking winch 20.

To ensure the correct winding of each hose in the groove of the wheel rim, on the one hand, and for correct alignment between the unwound hose and the wheel, on the other hand, it includes a device 22 for guiding each hose when it comes out of its storage groove, which essentially includes a guide sleeve 23 through which the hose passes and which is maintained by a support bar structure 24 in a position in which the sleeve is axially aligned with the tangent of the storage groove for the hose corresponding to the outlet location of the hose of that groove.

The wheel is also associated with a winch 26 that is placed on the rotary support plate 14 of the wheel and the function of which is to rotate the wheel using a cable 27 whereof one end is fixed to the wheel and the other end of which is wound around the winch. This winch also takes into account the fact that, in the idle state of the wheel in which the hoses are completely wound around the rim in their respective grooves, the free end bearing the connecting tip 17 hangs freely vertically from the wheel. Of course, the device for rotating the wheel can be completed by motor means for driving the axis 12 of the wheel, which could operate in parallel with the winch or in case of failure thereof.

Figure 6:
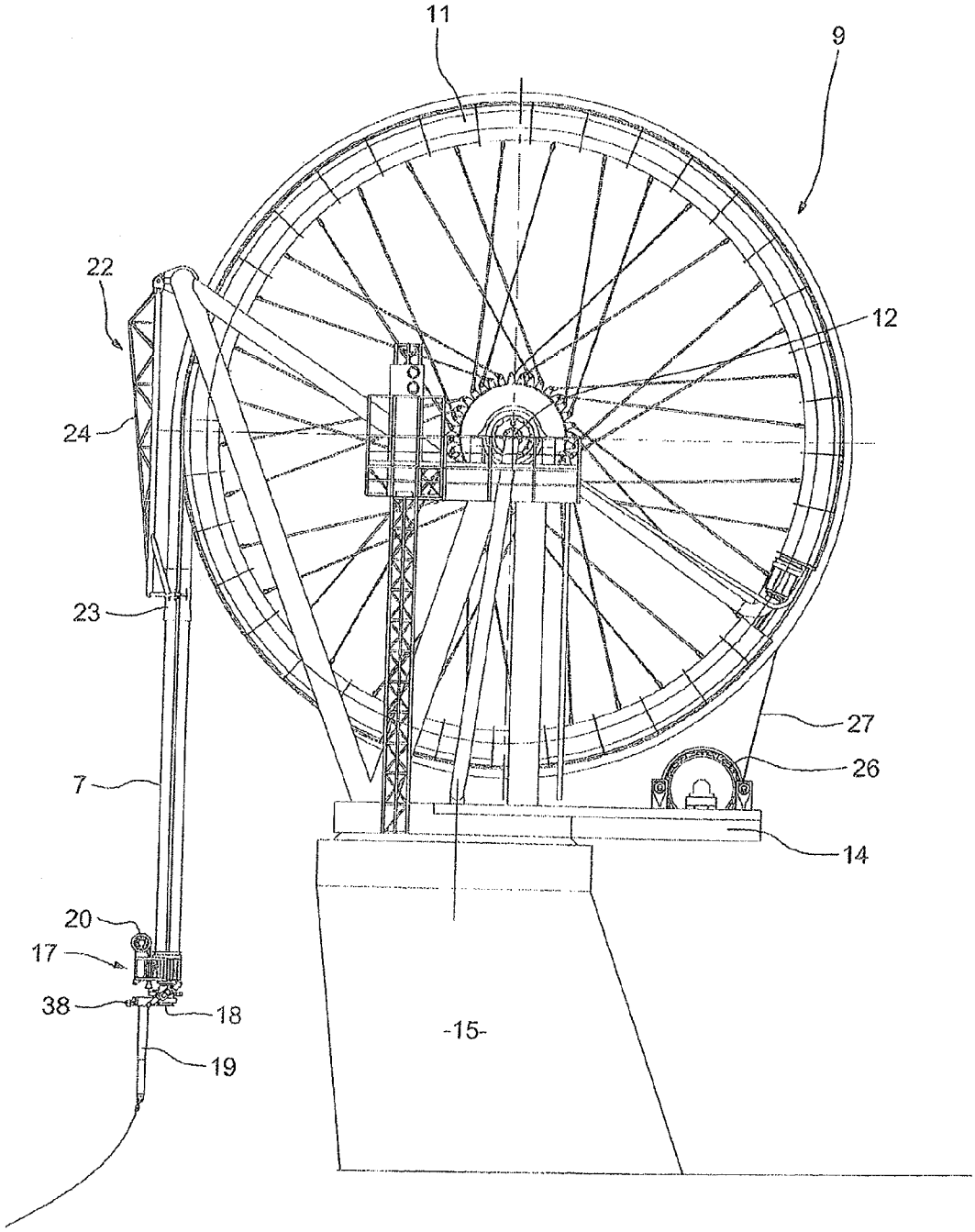
FIG. 6 is a view similar to FIG. 4, but shows the storage wheel in an idle position in which the hoses are wound around the periphery of the wheel.
Figure 7:
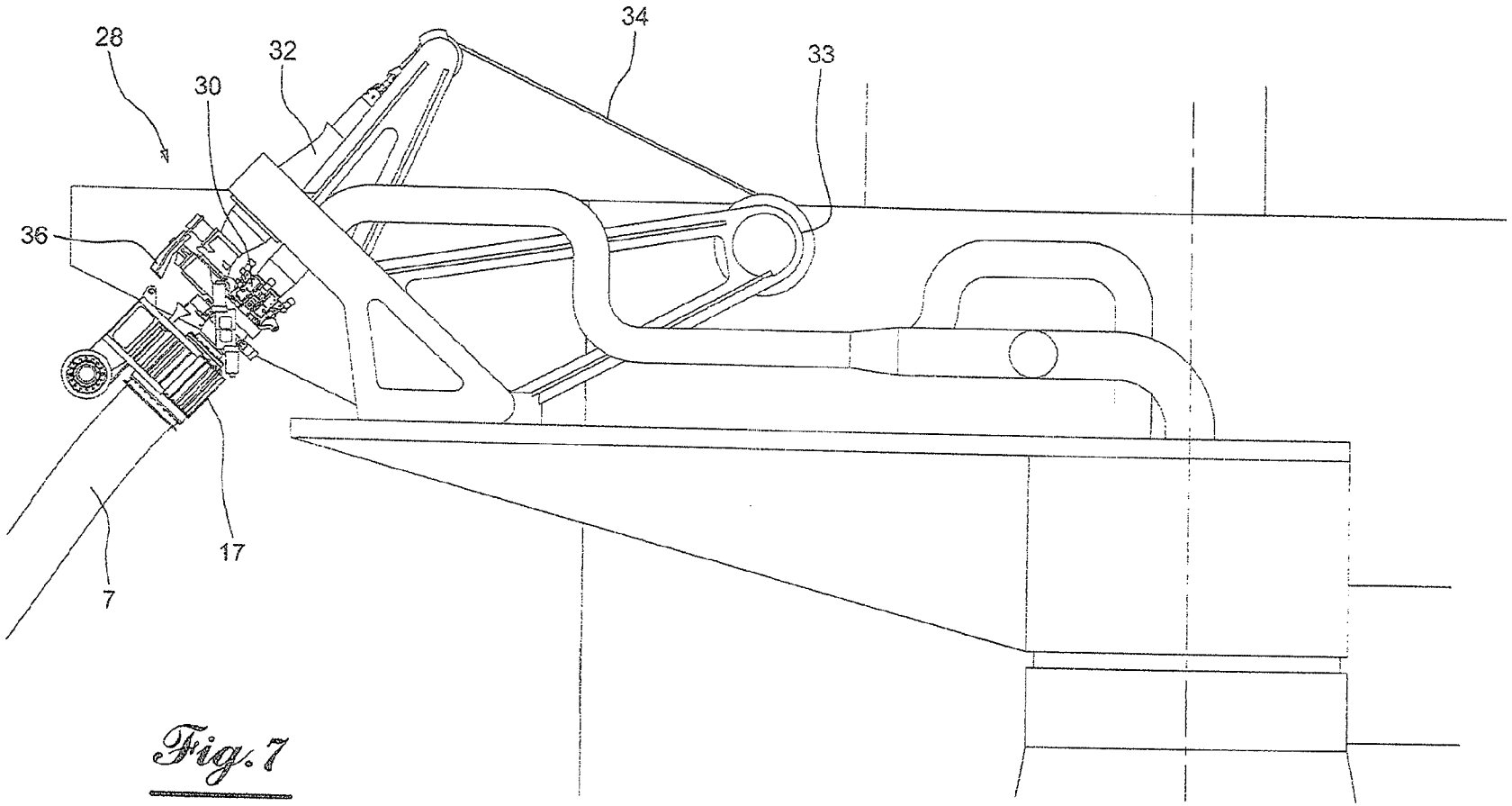
FIG. 7 is a larger-scale view of the device for receiving hoses of the shuttle, according to FIG. 3.
Figure 8:
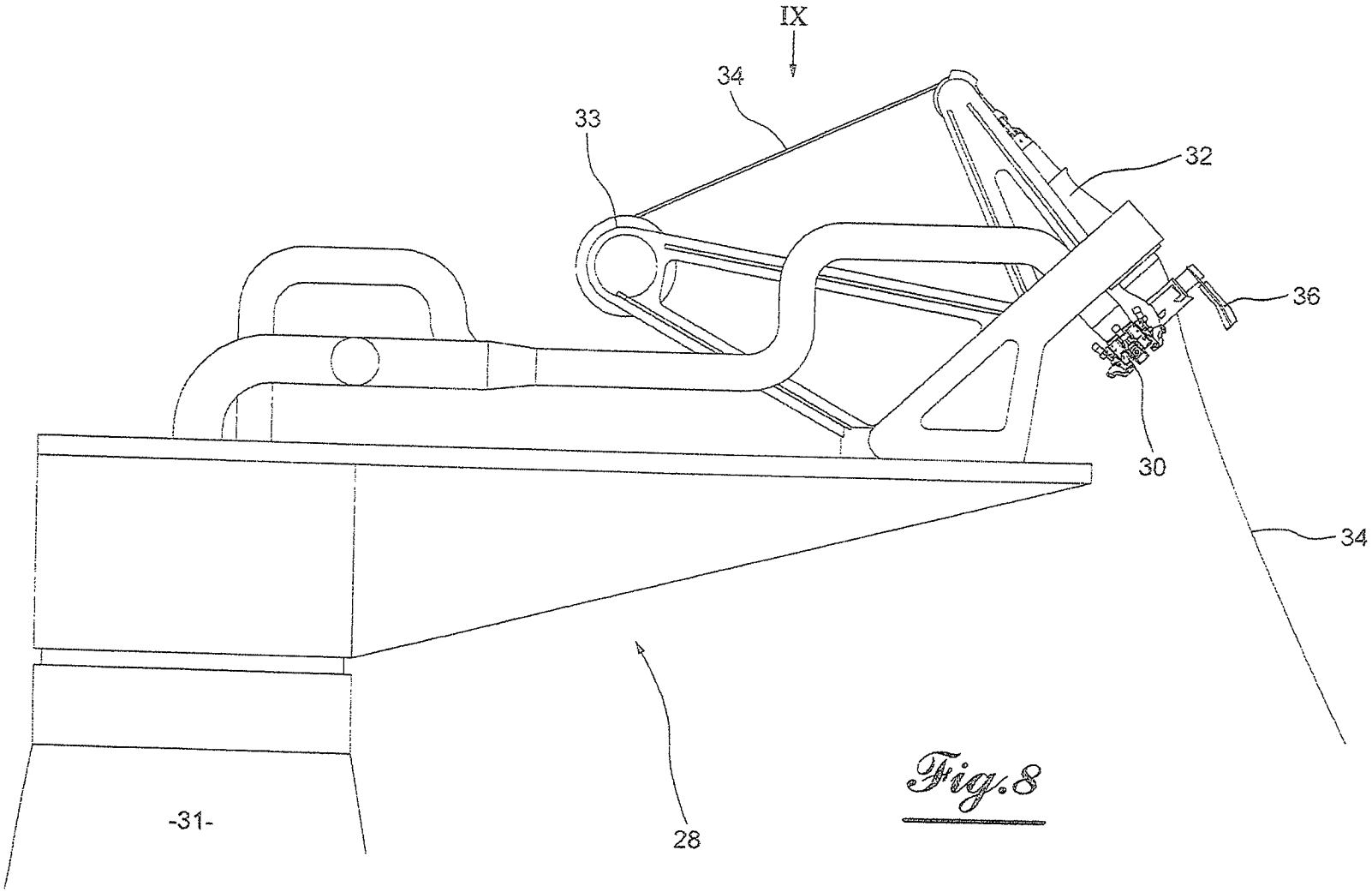
FIG. 8 shows said device of FIG. 7 before receiving the hoses.
Figure 9:
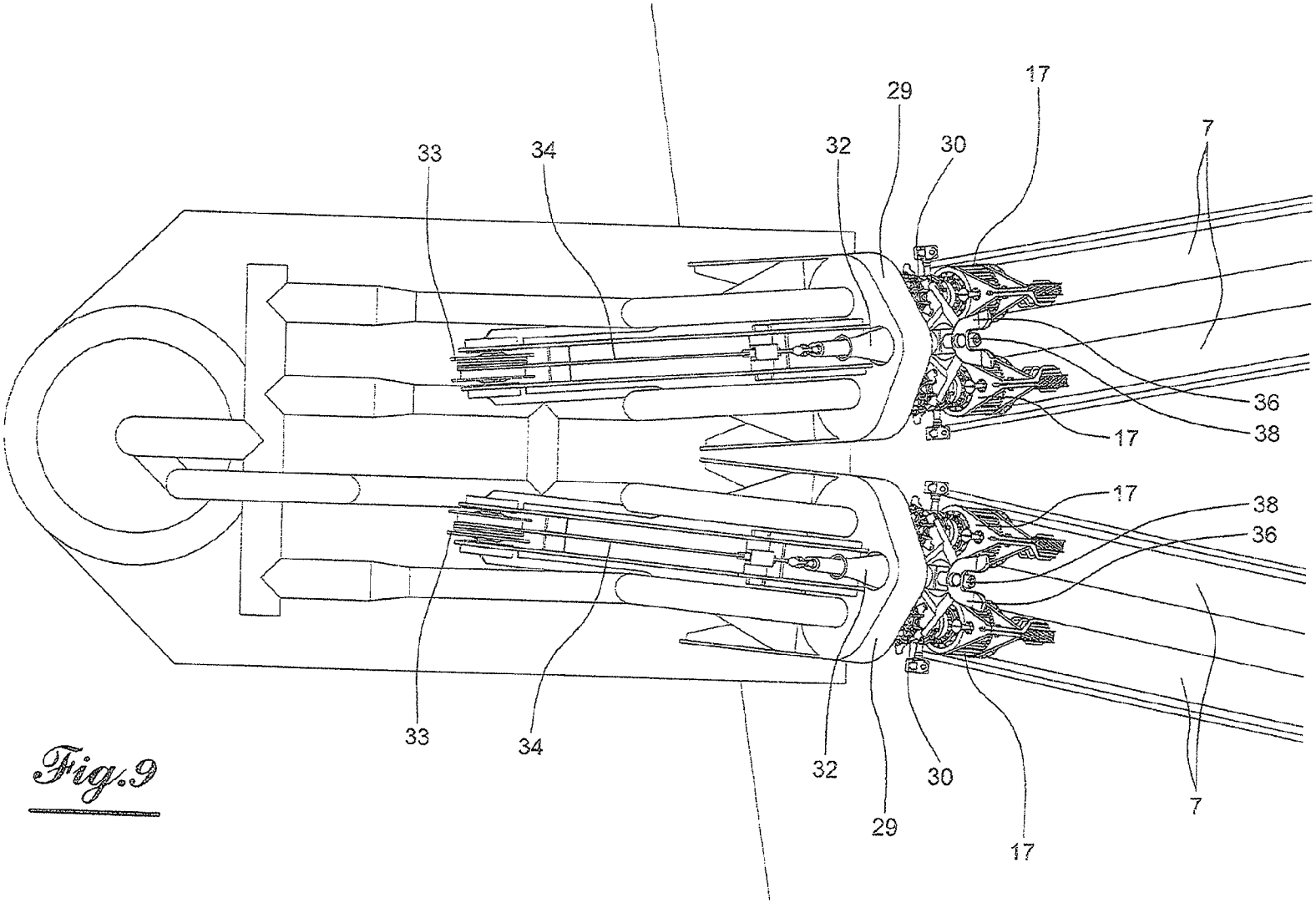
FIG. 9 is a top view in the direction of arrow IX of FIG. 8.

In reference in particular to FIGS. 3 and 7 to 9, one can see that the arrangement for receiving cryogenic hoses 7 on the shuttle 2 is made in the form of a head 28 supporting two connecting device 29, each of which includes two connectors 30 for connecting two connecting tips 17 of the two hoses 7 wound around a wheel. The head 28 is rotatably mounted around a vertical axis on a support tower 31 placed, according to the illustrated examples, either on the front portion (FIG. 1) or on the rear portion (FIG. 2) of the shuttle. Each support device 29 of each pair of connectors 30 for connecting the support device shared by the two connecting tips 17 of a pair of hoses includes a member for receiving and centering the shared pin 19 of the two tips, in the shape of a tube 32 and a winch 33 for winding the cable 34 that passes through the tube and is intended to be fixed, during a transfer, to the tip of the pin 19 to pull the latter toward the shuttle until the pin is engaged in the tube. To ensure the angularly correct orientation of the support of the two tips 17, the support 29 for the connectors includes a fork 36 that ensures the correct angular positioning of the clips 18 of the tips, using a roller 38 that is arranged on the support of the tips above the pin 19, as shown in FIG. 6. The fork 36, in cooperation with the roller 38, makes it possible to make up the angular positioning flaws of the support of the tips 17, which is relatively small, since the arrangement of the pin above the clips already ensures approximately correct angular positioning thereof relative to the connecting clips, due to the weight of said clips, the center of gravity being approximately vertically under the pin.

It emerges from the description provided above and from the figures that the storage on the wheels being able to have a diameter comprised between 20 and 50 meters, with a very large hose length, comprised between 60 and 120 meters, allows the shuttle to make significant movements, relative to the barge, longitudinally and transversely, during a LNG transfer. On the other hand, the possibility of the storage wheels on the barge and the head 28 for receiving the hoses on the shuttle has the extremely advantageous consequence that the wheels and the head are always oriented so that the hoses are not subjected to lateral or torsional stresses and always extend in a chain during a transfer between their two ends, one secured to the wheel and the other connected to the receiving head of the shuttle. The conveyance of the hose tips from the barge to the shuttle is done using the cable 34, the free end of which will be transported to the barge and fixed to the tip of the pin of the support assembly of the tips of the hoses and pulled into the tube 32 using the winch 33. Of course, the process of unwinding the hoses can be controlled, automatically, by appropriate control devices provided on the barge and/or the shuttle.

Owing to the use of the dynamic positioning system, allowing positioning with a lateral offset of the barge and substantially parallel thereto, the invention makes it possible to eliminate the formidable risk of the known transfer systems. The latter are designed to perform the loading operations, for example with oil, of the shuttles by providing positioning of the shuttle and the barge in tandem. The shuttle is enslaved to keep its longitudinal axis pointed toward the stern of the barge while being connected thereto by a hawser.

Although the shuttle is equipped with a dynamic positioning system, when the shuttle unduly travels forward toward the barge, the shuttle operators must try to regain control of the shuttle, in manual mode, in order to prevent the collision. But the significant inertia of the shuttles makes those maneuvers too long to avoid the collision.

As described above, the invention proposes another transfer configuration using the possibilities of dynamic positioning of the ship to no longer point the longitudinal axis of the shuttle toward the stern of the barge, but to keep its course substantially identical to the course of the barge and with a lateral offset. In case of failure of the dynamic positioning system, the proposed configuration makes it possible to minimize the risk of collision, since the shuttle is no longer enslaved to point toward the barge, but laterally offset and parallel thereto. By also equipping the transfer device, for example at the end of the hoses on the shuttle side, with emergency disconnect means, particularly advantageous in the case of liquefied natural gas transfer, an accidental movement of the shuttle relative to the barge is not problematic, even in the case of a relatively short hose.

Of course, various modifications can be made to the transfer system according to the invention as it is shown as an example in the figures. For example, it is possible to provide, in place of the wheels and to store the hoses, very long booms, supported by towers mounted on the barge, of the type described in French patent FR 2824529, on the condition the shuttle is positioned laterally offset from the barge and substantially parallel to the axis thereof is maintained, so that during an accidental movement of the shuttle, a collision with frontal impact thereof and the barge can be avoided. To prevent lateral contact between the shuttle and the barge from being able to produce significant damage, it is possible to provide, on the edge of the barge opposite the shuttle, defense elements 40 such as compressible blisters. The hoses extend in aerial chains as described but, if necessary, also in underwater or floating chains.

The invention claimed is:

1. A method for transferring fluids between a first ship and a second ship, each of the first and second ships having a respective longitudinal axis, the method comprising:

placing the second ship at a predetermined distance from the first ship, with the second ship laterally offset from the first ship, and the longitudinal axes of the first and second ships generally parallel to each other;

guiding at least one flexible fluid transfer conduit of a fluid transfer system from the first ship to the second ship; and transferring the fluid from the first ship to the second ship through the flexible fluid transfer conduit, while maintaining the first and second ships laterally offset and the longitudinal axis of the second ship generally parallel to the longitudinal axis of the first ship so that the second ship will move along the longitudinal axis of the second ship, avoiding collision between the first and second ships.

2. The method according to claim 1, comprising transferring liquefied natural gas, wherein the flexible fluid transfer conduit comprises cryogenic hoses extending in a catenary shape between and connected to the first ship and the second ship.

3. A system for transferring fluids between a first ship and a second ship, each of the first ship and the second ship having a respective longitudinal axis, the system comprising:

at least one flexible conduit having a connecting tip;

a storage device on the first ship for storing at least one of the at least one flexible conduit, wherein the storage device includes a conduit outlet mechanism that rotates around a first vertical axis a support device, and a storage wheel including a rim having two grooves, wherein each groove is provided for storing one of the at least one flexible conduit, the storage wheel rotates around a horizontal axis and pivots around the first vertical axis, on the support device, and a shared support on which the connecting tip of the at least one flexible conduit is mounted, wherein the shared support has a centering pin oriented parallel to an axis of a connector of the connecting tip of the at least one flexible conduit, and positioned above the connecting tip;

a receiving arrangement receiving the connecting tip of the at least one flexible conduit, wherein the receiving arrangement is located on the second ship, rotates around a second vertical axis, and permits the at least one flexible conduit to extend in a catenary shape between ends of the at least one flexible conduit, when the at least one flexible conduit is suspended between the ends of the at least one flexible conduit, and includes a rotary support head supporting a connecting device, and the connecting device includes two connectors for connecting to connecting tips of two flexible conduits; and a dynamic positioning system located on the second ship and maintaining the second ship laterally offset from the first ship and with the longitudinal axis of the second ship generally parallel to the longitudinal axis of the first ship to avoid collision between the first and second ships.

4. The system according to claim 3, wherein the storage wheel includes a guiding device for guiding and aligning the at least one flexible conduit coming out of one of the grooves in the rim of the storage wheel during unwinding of the at least one flexible conduit.

5. The system according to claim 3, including a support tower, wherein the receiving arrangement receiving the connecting tip of the at least one flexible conduit comprises a head mounted on the support tower and rotating around the second vertical axis.

6. The system according to claim 3 including a fall braking winch on the shared support.

7. The system according to claim 3, wherein the receiving arrangement includes a receiving and centering member for receiving and centering the centering pin.

8. The system according to claim 7, wherein the receiving and centering member is a tube, and the connecting device includes a winch for winding a cable that passes through the tube, and the cable is fixed to the centering pin when transferring a fluid between the first ship and the second ship through the at least one flexible conduit.

9. The system according to claim 8, wherein the connecting device includes a fork for correct angular positioning of clips of the connecting tip of the at least one flexible conduit, and a roller located on the shared support, above the centering pin.

10. The system according to claim 3, wherein the storage wheel has a diameter in a range from 20 m to 50 m.

11. The system according to claim 3, wherein the system includes thrusters controlled by the dynamic positioning system.

12. The system according to claim 11, including emergency disconnect means for disconnecting the at least one flexible conduit in an emergency.

13. A method for transferring a fluid between a first ship and a second ship, each of the first and second ships having a respective longitudinal axis, the method comprising:

placing the second ship at a predetermined distance from the first ship, with the longitudinal axes of the first and second ships generally parallel to each other;

guiding at least one flexible fluid transfer conduit of a fluid transfer system from the first ship to the second ship, with a first end of the flexible fluid transfer conduit located on the first ship and a second end of the flexible fluid transfer conduit located on the second ship;

arranging the first and second ends of the flexible fluid transfer conduit to be freely rotatable on the first ship and on the second ship, respectively, so that the flexible fluid transfer conduit extends in a catenary manner between the first and second ends;

transferring the fluid from the first ship to the second ship through the flexible fluid transfer conduit; and maintaining the second ship and the longitudinal axis of the second ship laterally offset from and generally parallel to the longitudinal axis of the first ship so that the second ship will move along the longitudinal axis of the second ship, avoiding collision between the first and second ships.

* * * * *

UNITED STATES PATENT AND TRADEMARK OFFICE

CERTIFICATE OF CORRECTION

PATENT NO. : 9,260,164 B2
APPLICATION NO. : 13/319553
DATED : February 16, 2016
INVENTOR(S) : Bernard Dupont It is certified that error appears in the above-identified patent and that said Letters Patent is hereby corrected as shown below:

On the title page

Item (73) Assignee

Change "SOCIETE EUROPEENNE D'INGENIERIE MACANIQUE—EURODIM, Rueil Malmaison (FR)" to -- SOCIETE EUROPEENNE D'INGENIERIE MECANIQUE—EURODIM, Rueil Malmaison (FR) --.

Signed and Sealed this
Seventeenth Day of May, 2016

Michelle K. Lee

Michelle K. Lee
*Director of the United States Patent and Trademark Office*